US007173207B2

(12) United States Patent
Lösbrock et al.

(10) Patent No.: US 7,173,207 B2
(45) Date of Patent: Feb. 6, 2007

(54) APPARATUS AT A SPINNING PREPARATION MACHINE FOR DETECTING WASTE SEPARATED OUT FROM FIBRE MATERIAL

(75) Inventors: Peter Lösbrock, Mönchengladbach (DE); Christoph Färber, Korschenbroich (DE)

(73) Assignee: Trützschler GmbH & Co. KG, Monchengladbach (DE)

( * ) Notice: Subject to any disclaimer, the term of this patent is extended or adjusted under 35 U.S.C. 154(b) by 36 days.

(21) Appl. No.: 10/814,635

(22) Filed: Apr. 1, 2004

(65) Prior Publication Data

US 2004/0195156 A1 Oct. 7, 2004

(30) Foreign Application Priority Data

Apr. 3, 2003 (DE) ..... 103 15 136
Oct. 21, 2003 (DE) ..... 103 49 407

(51) Int. Cl.
*B07C 5/342* (2006.01)
*D01G 15/00* (2006.01)

(52) U.S. Cl. ..... 209/576; 209/587; 19/107; 19/109

(58) Field of Classification Search ..... 209/576, 209/577, 587, 643, 925; 19/98, 107, 108, 19/109, 205
See application file for complete search history.

(56) References Cited

U.S. PATENT DOCUMENTS 4,858,277 A * 8/1989 Pinto et al. ..... 19/200
5,130,559 A * 7/1992 Leifeld et al. ..... 250/559.11
5,181,295 A * 1/1993 Demuth et al. ..... 19/65 A
5,255,415 A * 10/1993 Leifeld et al. ..... 19/107
5,819,373 A 10/1998 Schlichter et al.
6,477,741 B2 * 11/2002 Hosel ..... 19/107
6,865,781 B2 * 3/2005 Hosel ..... 19/200
6,889,406 B2 * 5/2005 Schmitz ..... 19/107
2002/0078532 A1 6/2002 Hosel et al.

FOREIGN PATENT DOCUMENTS

EP 0 226 430 6/1987
EP 0 399 315 A1 11/1990
GB 2 370 285 A 6/2002

* cited by examiner

*Primary Examiner*—Joseph C. Rodriguez
(74) *Attorney, Agent, or Firm*—Venable LLP; Robert Kinberg; Steven J. Schwarz

(57) ABSTRACT

In an apparatus at a spinning preparation machine, for example a cleaner, opener, carding machine or the like, for detecting waste which is separated out from fibre material, for example cotton, and consists of foreign matter and good fibres and which is collected in a collecting device, there is provided an optical measuring device having a brightness sensor, which measuring device examines the waste.

In order to make it possible, by simple means, for the content of good fibres in the waste to be detected and to allow optimum adjustment of the composition of the waste, especially with a high content of trash and low content of good fibres, the waste material is moved past at least one sensor arrangement responding to good fibres, and the sensor arrangement comprises a light source, the light reflected by the moving good fibres being detected by the brightness sensor and being converted into electrical signals, from which the good fibre content can be determined.

17 Claims, 7 Drawing Sheets

Section I-I

APPARATUS AT A SPINNING PREPARATION MACHINE FOR DETECTING WASTE SEPARATED OUT FROM FIBRE MATERIAL

CROSS REFERENCE TO RELATED APPLICATION

This application claims priority from German Patent Application Nos. 103 15 136.2 and 103 49 407.3, which are incorporated herein by reference.

BACKGROUND OF THE INVENTION

The invention relates to an apparatus at a spinning preparation machine, for example a cleaner, opener, carding machine or the like, for detecting waste which is separated out from fibre material, for example cotton.

The fibre material typically consists of foreign matter and good fibres, and may be collected in a collecting device, wherein there is provided an optical measuring device having a brightness sensor, which measuring device examines the waste. In a known apparatus (EP-A-0 399 315), the beater pins of a cleaning roller convey the fibre flocks over cleaning bars which are adjustable so that the intensity of cleaning can be varied. Below the cleaning bars, a brightness sensor measures the brightness as a measure of the contaminant content of the offtake (waste), which has been separated out by the cleaning bars and is collected in a funnel-like collecting device. At prespecified time intervals, the offtake is drawn off under suction by way of a suction conveyor arranged at the lower end of the collecting device. The brightness—measured by the brightness sensor—of the separated-out waste, in the form of a signal, is input into a control system and displayed on a display. One disadvantage is that the sensor serves only for detecting the contaminant content; the content of good fibres is not detected. It is furthermore disadvantageous that the determined degree of cleaning is investigated, by sensors, in the offtake chamber of the cleaning machine. Finally, the brightness, that is to say the degree of brightness—measured by the sensor—of the offtake is merely input into the control system without, however, any optimum operating point of the cleaning machine being derived therefrom.

It is an aim of the invention to provide an apparatus of the kind described at the beginning which avoids or mitigates the mentioned disadvantages and which especially makes it possible for the content of good fibres in the offtake to be detected by simple means and allows optimum adjustment of the composition of the offtake, especially to have a high content of foreign matter (trash) and a low content of good fibres.

SUMMARY OF THE INVENTION

The invention provides a spinning preparation machine in which waste can be separated from fibre material, having a sensor arrangement including a light source and a brightness sensor for examining waste, and further having a measurement element, wherein the waste can be conveyed past the sensor arrangement and the brightness sensor is arranged to receive light from the light source reflected by the waste, the received light being convertible into electrical signals which are measurable by the measurement element.

The measures according to the invention make it possible for the content of good fibres in the offtake to be detected automatically and allow optimum adjustment of the composition of the offtake (trash/good fibres) by simple means.

The brightness sensor and the subsequent evaluation provide precise information relating to the content of good fibres in the offtake, that information being usable for adjustment of the separating elements. In the process, a continuous, objective and, accordingly, personnel-independent assessment of the separated-out waste can be carried out. It is, especially, possible to determine, and if necessary to influence, the amount of good fibres that are, undesirably, also separated out. Existing machine elements can be so adjusted in dependence upon the results obtained that a predetermined, desired waste composition is obtained automatically. It is especially advantageous that the variation in the brightness signal (coefficient of variation/standard deviation of light reflection) corresponds to the quantitative distribution curve of the waste (trash/good fibres), from which an optimum operating point can be derived for adjustment of the separating elements for the cleaning of the fibre material. The function between the coefficient of variation and, for example, the position of the adjustable guide vanes of the cleaning machine may exhibit a characteristic change in the gradient (gradient endpoint or range) which corresponds to the optimum operating point for cleaning. Determining the optimum operating point can be carried out by means of an arrangement that is very simple in terms of apparatus, which constitutes a further advantage.

The collecting device may be a pneumatic pipe-line. The collecting device may be a suction offtake hood.

Advantageously, the waste is moved through the collecting device. The brightness sensor may be arranged in the wall region of the pipe-line or suction offtake hood. The brightness sensor may be located in the region of an end face of the pipe-line or suction offtake hood. The brightness sensor may comprise at least one photoelectric element, for example, at least one photodiode. The brightness sensor may be capable of detecting changes in voltage caused by differences in brightness. Advantageously, the brightness sensor is connected to an electronic evaluation device. The light source may be a direct-current illuminator. The light source may be an alternating-current illuminator. The light source is advantageously arranged in the immediate vicinity of the brightness sensor, for example, next to the brightness sensor. Advantageously, the sensor system operates in incident light. Advantageously, the variation in the brightness of the good fibres is arranged to be determined. Advantageously the coefficient of variation of the brightness of the good fibres is arranged to be determined. Advantageously, the standard deviation of the brightness of the good fibres is arranged to be determined. Advantageously, detection and assessment of the waste are carried out automatically. Advantageously, detection and assessment of the waste are carried out continuously. Advantageously, the measurement results of the evaluation device are compared with prespecified quantities. Advantageously, in the event of a departure from prespecified quantities, the waste separation can be modified. Advantageously, at least one opto-electronic brightness measurer is integrated into the suction offtake lines through which the waste is taken off under suction. Advantageously, more than one electronic evaluation device is provided. Advantageously, more than one opto-electronic brightness measurer is connected to evaluation devices. Advantageously, the evaluated measurement results relating to the consistency of the waste are compared with prespecified values and used for automatically modifying machine elements influencing separation. Advantageously, the at least one evaluation device is in communication with the associated machine control. Advantageously, the evaluated measurement results of the separation procedures are shown on the machine operating and display unit. Advantageously, the evaluated measurement results of the separation procedures are passed on to other, possibly superordinate and central, systems. Advantageously, at least one opto-electronic brightness measurer is associated with each machine. Advantageously, at least one opto-electronic brightness measurer is arranged on each side of a machine. Advantageously, the at least two brightness sensors are in communication with a central evaluation device. Advantageously, different light sources are provided. Advantageously, light sources of different colours are provided, for example red light and infra-red light. Advantageously, at least one source of incident light is provided. Advantageously, the evaluated measurement results are used for adjusting at least one guide vane associated with the roller. Advantageously, the evaluated measurement results are used for adjusting at least one separating blade associated with the roller. Advantageously, the at least one electronic evaluation device (measuring element) is in communication with an electronic control and regulation device, for example a microcomputer. Advantageously, the machine elements such as guide vanes, separating blades and the like are arranged to be automatically adjusted in dependence upon the evaluated measurement results. Advantageously, the cleaning capability of the machine is modifiable in dependence upon the evaluated measurement results. Advantageously, the nature of the waste (amount, composition) is modifiable in dependence upon the evaluated measurement results. Advantageously, at least one separate brightness sensor is associated with each suction offtake location or guide vane. Advantageously, the brightness sensor is associated with a central waste-collecting line. Advantageously, a window for the brightness sensor is provided in each waste-collecting line. Advantageously, a window for an illumination device is provided in each waste-collecting line. Advantageously, the evaluated measurement results are used for determining the ratio of the good fibre content to the contaminant content. Advantageously, the evaluated measurement results are used for assessing the quality of the fibre material being processed. Advantageously, a machine is in communication with a central evaluation device, to which more than one brightness sensor is connected. Advantageously, the electronic control and regulation device, for example a computer, has a memory for comparison data. Advantageously, the evaluation device is in communication with a superordinate electronic evaluation system, for example KIT. Advantageously, the measurement values of the brightness sensor are convertible into electrical signals. Advantageously, the evaluated measurement results are used in a control and regulation circuit for optimising the cleaning of the fibre material. Advantageously, the illumination device or light source operates using visible light. Advantageously, the content of good fibres is arranged to be determined. Advantageously, at least one angle-measuring device is connected to the control and regulation device. Advantageously, at least one brightness sensor is connected to the control and regulation device. Advantageously, at least one actuating element is connected to the control and regulation device. Advantageously, the sensor arrangement is used for determining a blockage of fibre material in the collecting line. Advantageously, a blockage in a suction hood is determined. Advantageously, a static state of the electrical signal caused by the blockage is arranged to be detected. Advantageously, exceeding, or falling below, a limit value for the electrical signal caused by the blockage is arranged to be detected. Advantageously, the machine control issues an error message on the basis of the blockage.

The invention also provides an apparatus at a spinning preparation machine, for example a cleaner, opener, carding machine or the like, for detecting waste which is separated out from fibre material, for example cotton, and consists of foreign matter and good fibres and which is collected in a collecting device having a brightness sensor, which measuring device examines the waste, characterised in that the waste material is moved past at least one sensor arrangement responding to good fibres, and the sensor arrangement comprises a light source, the light reflected by the moving good fibres being detected by the brightness sensor and being converted into electrical signals, which are measured by a measurement element.

The invention also provides a method of monitoring waste in a spinning preparation machine, comprising conveying the waste past a location in which it can be examined by a sensor arrangement, so illuminating waste in said location that reflected light from the waste can be detected by a brightness sensor, converting data relating to the brightness of the waste to electrical signals, and evaluating the electrical signals to ascertain information relating to the composition of the waste.

DETAILED DESCRIPTION OF THE PREFERRED EMBODIMENTS

Figure 1A:
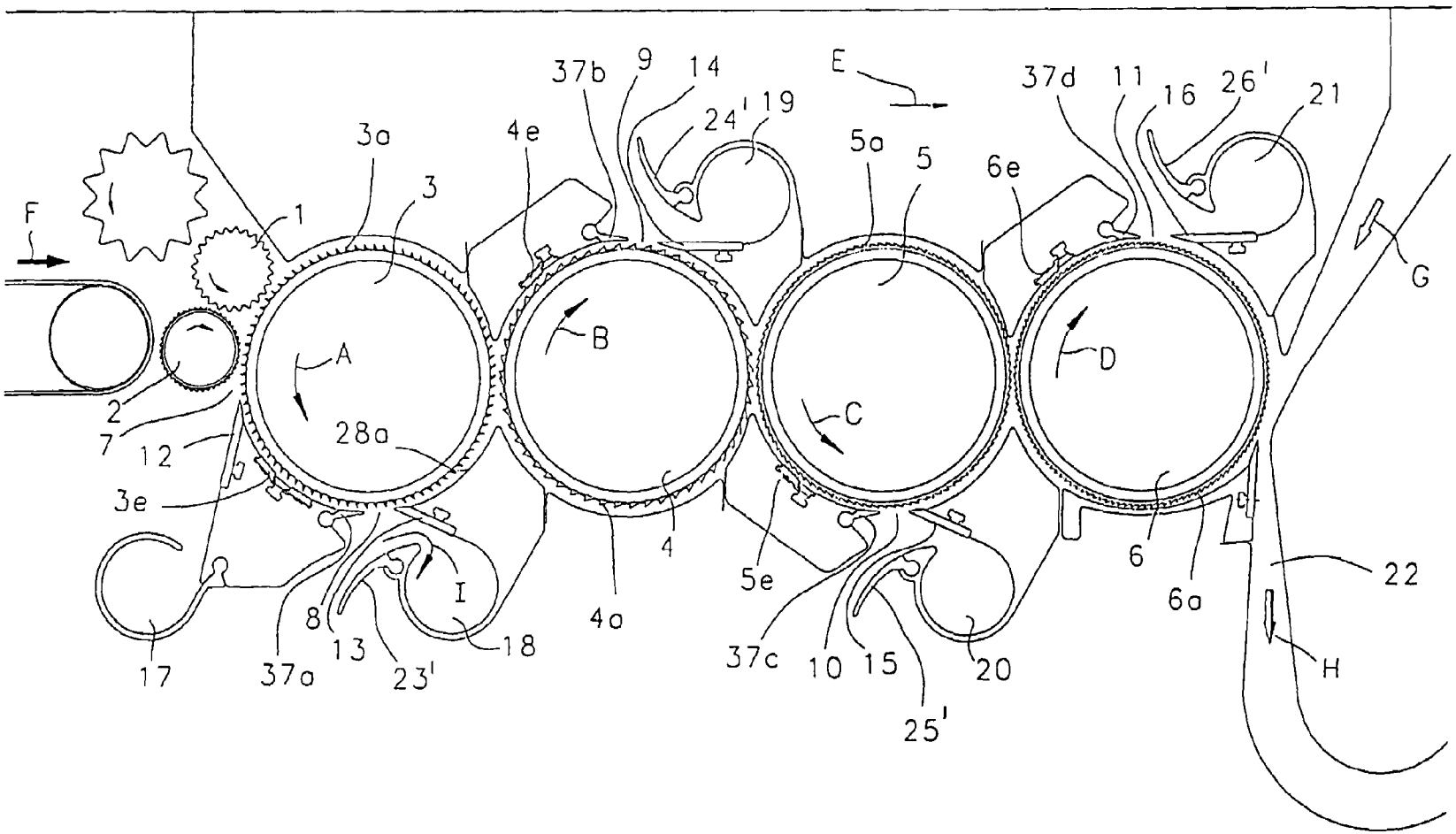
FIG. 1*a* is a diagrammatic cross-sectional side view of a cleaning machine having several suction hoods for waste.

With reference to FIG. 1*a*, the fibre material to be cleaned (arrow F), especially cotton, in flock form, is fed to the cleaning apparatus, for example a CVT 4 cleaning apparatus made by Trützschler GmbH & Co. KG of Mönchengladbach, Germany, which is arranged in an enclosed housing. That is accomplished, for example, by means of a charging shaft (not shown), a conveyor belt or the like. The lap is fed, by two feed rollers 1, 2, with nipping, to a pinned roller 3, which is rotatably mounted in the housing and rotates in an anti-clockwise direction (arrow A). Downstream of the pinned roller 3 there is arranged a clothed roller 4 covered by a sawtooth clothing. The roller 3 has a circumferential speed of about 10 to 21 m/sec. The roller 4 has a circumferential speed of about 15 to 25 m/sec. Roller 5 has a higher circumferential speed than roller 4, and roller 6 has a higher circumferential speed than roller 5. Downstream of rollers 3 and 4 there are successively arranged two further sawtooth rollers 5 and 6, the directions of rotation of which are denoted by reference letters C and D, respectively. Rollers 3 to 6 have a diameter of about from 150 to 300 mm. The pinned roller 3 is enclosed by the housing. Associated with the pinned roller 3 is a separation opening 7 for removing fibre contaminants, the size of which opening is modified or modifiable according to the degree of contamination of the cotton. Associated with the separation opening 7 is a separating edge 12, for example a blade. In the direction of arrow A there are provided, at the roller 3, further separation opening 8 and a separating edge 13. A separation opening 9 and a separating edge 14 are associated with the sawtooth roller 4, a separation opening 10 and a separating edge 15 are associated with the sawtooth roller 5, and a separation opening 11 and a separating edge 16 are associated with the sawtooth roller 6. A suction offtake hood 17 to 21 is associated with each separating blade 12 to 16. Reference letter E denotes the work direction of the cleaner.

Figure 1B:
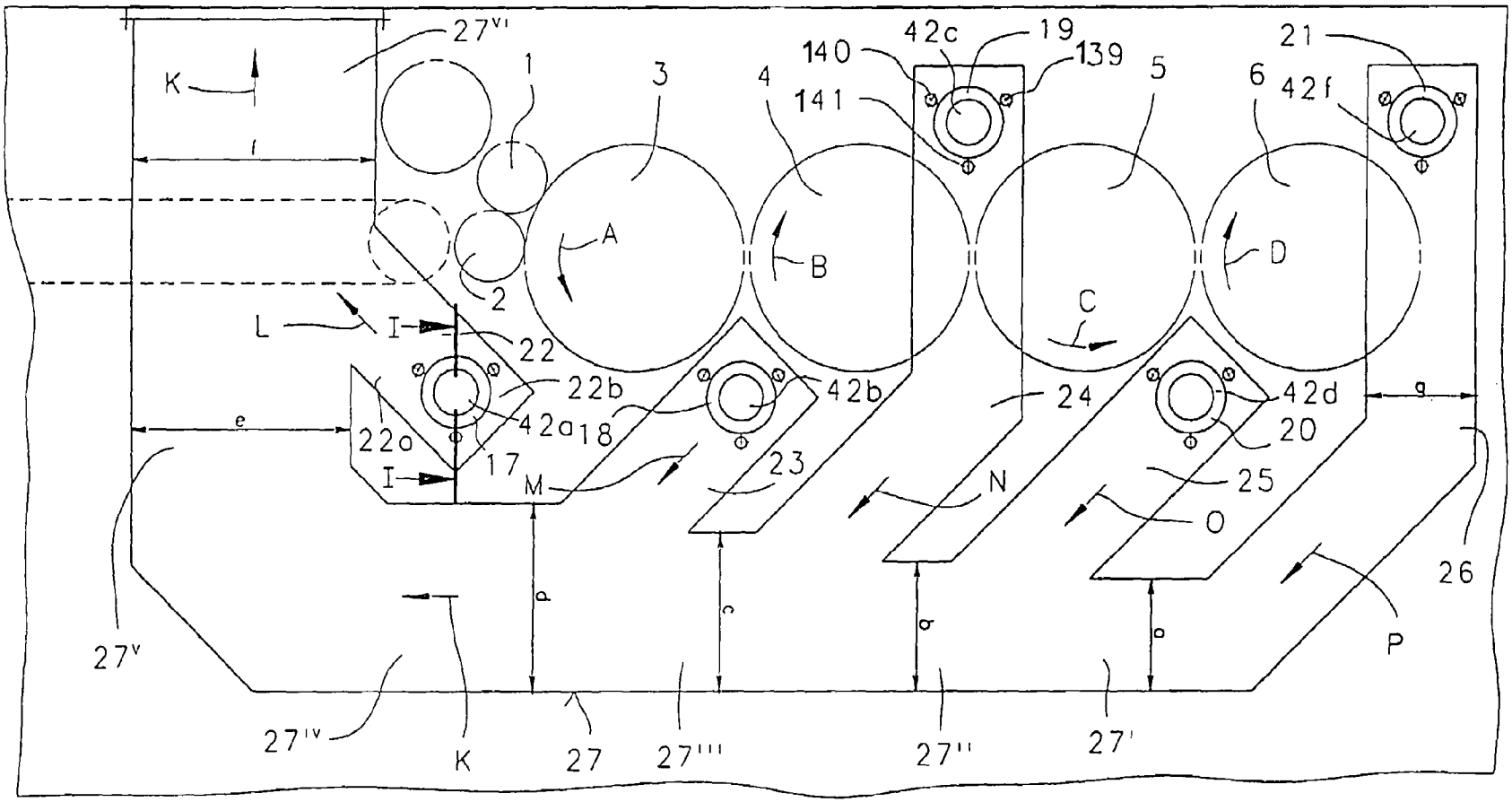
FIG. 1*b* is a side view of the cleaner of FIG. 1*a* having apparatuses according to the invention.

In accordance with FIG. 1*b*, a suction offtake line 22, 23, 24, 25 and 26 is associated with each suction offtake hood 17, 18, 19, 20 and 21, respectively. The suction offtake lines 22 to 26 are in communication with a common suction offtake channel 27. The rigid suction offtake lines 22 to 26 and the suction offtake channel 27 are of integral construction of, for example, sheet metal or plastics material. The lengths of the suction offtake lines 22 to 26 differ according to the distance between the suction offtake hood 17 to 21 and the suction offtake channel 27. The cross-sections $\mathbf{27}^{I}$ to $\mathbf{27}^{V}$ of the suction offtake channel 27—seen in the direction of flow (arrow K)—are located downstream of the entry of each suction offtake line 22 to 26. The end of the suction offtake channel 27 is connected to a suction source (not shown). The directions of flow within the suction offtake lines 22 to 26 are shown by arrows L to P.

The mode of operation is as follows: The lap consisting of fibre flocks (F) is fed from the feed rollers 1, 2, with nipping, to the pinned roller 3, which combs through the fibre material and takes up fibre tufts on its pins. When the roller 3 passes the separation opening 7 and the separating edge 12, the centrifugal force, in dependence upon the circumferential speed and curvature of that roller and also upon the size of the separation opening 7, which is matched to that first separation step, causes waste (short fibres and coarse contaminants) and a certain (per se undesirable) amount of good fibres to be flung out from the fibre material remaining on the roller; the material passes through the separation opening 7 into a suction offtake hood 17 (contaminants) in the housing. The fibre material pre-cleaned in that manner is taken off the first roller 3 by the tips of the clothing of the clothed roller 4 and is further opened out. When the rollers 4, 5 and 6 pass the separation openings 9, 10 and 11, respectively, having separating edges 14, 15, and 16, respectively, further contaminants are flung out from the system of fibres as a result of the centrifugal force.

Arrows B, C and D denote the directions of rotation of the clothed rollers 4, 5 and 6, respectively. Reference numerals 17 to 21 denote suction offtake devices for the contaminants leaving by the separation openings 7 to 11, respectively. The directions of rotation A, B, C and D of rollers 3, 4, 5 and 6, respectively, are different at adjacent rollers. At the end of the final roller 6 there is provided a pneumatic suction offtake device 22 for the cleaned fibre material (arrow H). The circumferential speed of each downstream roller is greater than the circumferential speed of the respective upstream roller. Reference numerals 23' to 26' denote adjustable air-guiding elements mounted at the air entry openings of the suction offtake hoods 18 to 21, by means of which elements the amount of air drawn in can be adjusted. In the walls of the suction offtake channels 27*a*, 27*b* for the suction offtake hoods 17 to 21 there is mounted at each end face, that is to say coaxially with respect to the suction offtake hood 17 to 21, a transparent pane 40*a* to 40*e* (see FIG. 2) so that it is possible to see into the suction offtake hood 17 to 21 from the outside. Associated with each of the panes 40*a* to 40*e* is a sensor arrangement 42 according to the invention (individual sensor arrangements being shown as 42*a* to 42*g* in the drawings), located outside the suction offtake channels 27*a*, 27*b*, by means of which the waste flowing through the suction offtake hood 17 to 21 and into the suction offtake channel 27*a*, 27*b* is detected by the sensor arrangement 42. Reference numerals 139, 140 and 141 indicate fixing devices.

Figure 2:
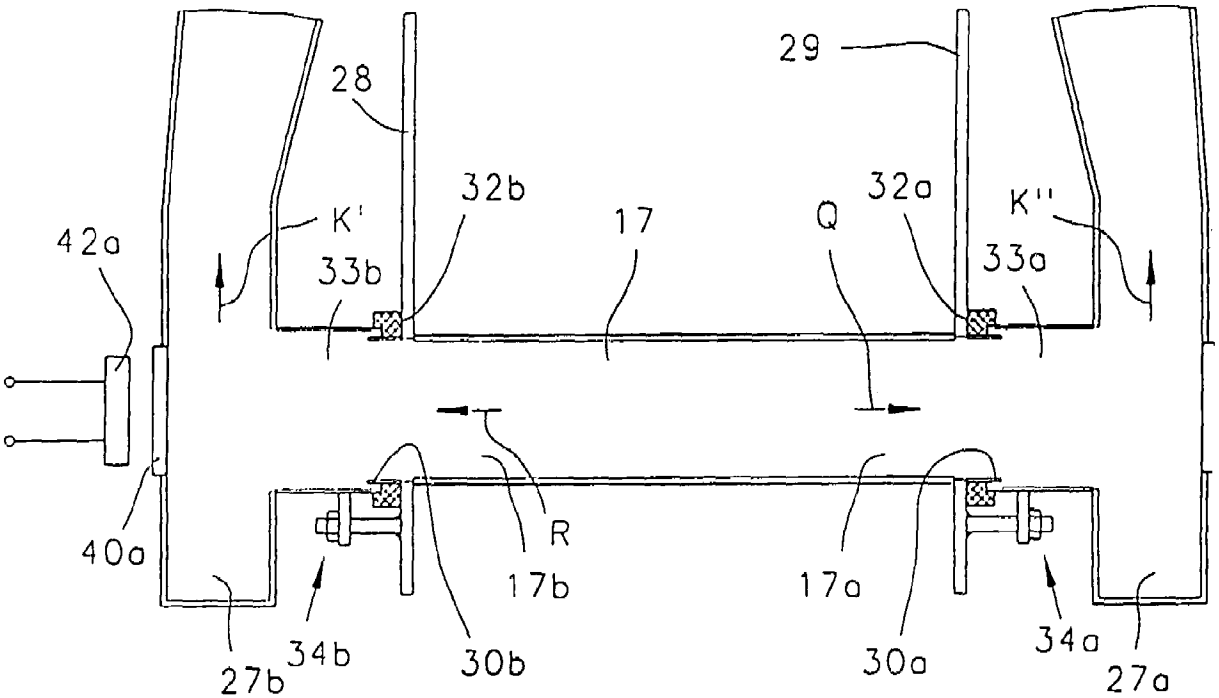
FIG. 2 is a cross-sectional front view, along I—I in FIG. 1*b*, of a part of a cleaner similar to that of FIG. 1*b* having an apparatus according to the invention arranged at a suction offtake channel.
Figure 4:
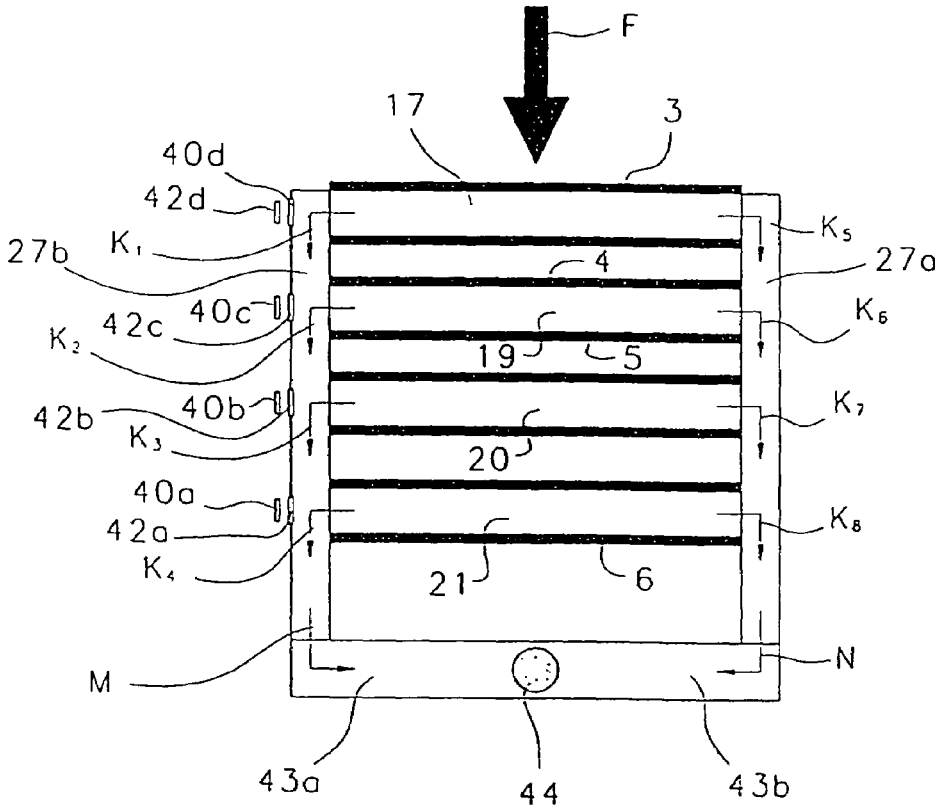
FIG. 4 is a top view of a part of the cleaner according to FIG. 1*b*.

In accordance with FIG. 2, the suction offtake hood 17 is arranged between the two frame walls 28, 29 (housing walls); a connection piece 30*a*, 30*b* is provided outside the walls 28, 29 at each end 17*a*, 17*b* of the suction offtake hood 17 so that the suction offtake hood 17 passes through two openings in the frame walls 28, 29. A resilient annular seal 32, for example made from foamed material, is placed around the connection pieces 30. In the arrangement of FIG. 1*b*, one end region 22*a* of the suction offtake line 22 opens out into the suction offtake channel 27*a*; the other end region 22*b* of the suction offtake line 22 opens out into the suction offtake channel 27*b*. Reference numeral 34 denotes a fastening element, for example a screw connection. The ends of the suction offtake channels 27*a*, 27*b* are connected to a common suction offtake channel 44 (see FIG. 4), which is connected to a suction source (not shown). The connection of the suction offtake line 22*a* to the suction offtake hood 17 and the suction offtake channel 27*a* corresponds to the connection of the suction offtake line 22*b* to the suction offtake hood 17 and the suction offtake channel 27*b*. On each outer face of the suction offtake channels 27*a*, 27*b* there is mounted a transparent pane 40*a* and 40*b*, respectively, with which there is associated a camera 41*a* and 41*b*, respectively, outside the suction offtake channels 27*a* and 27*b*, respectively, which camera is used for detecting the waste. In FIG. 4, only the sensor arrangements on channel 27*b* are shown; the sensor arrangements on channel 27*a* are of the same general construction but are not shown in FIG. 4. Arrows Q and R denote the flow directions of the suction offtake streams inside the suction offtake hood 17.

Figure 3A:
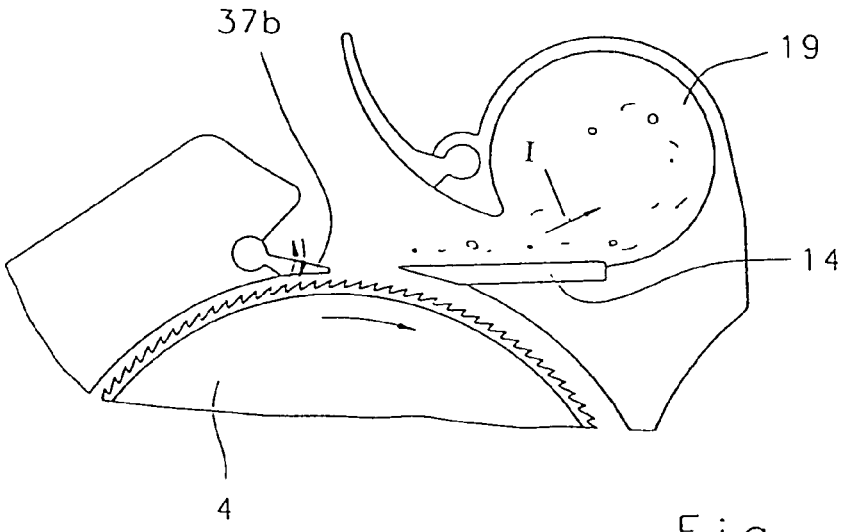
FIG. 3*a* shows a waste-separating location with a waste-separating arrangement having an adjustable guide vane.
Figure 3B:
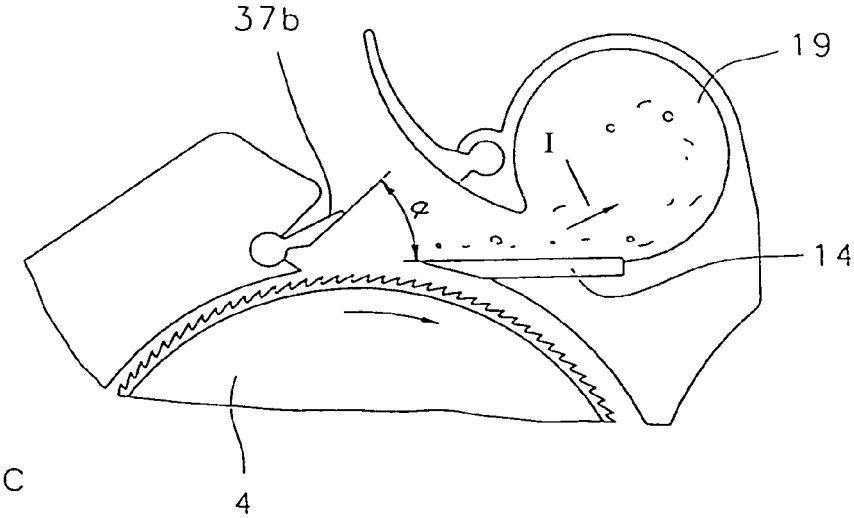
FIG. 3*b* shows the waste-separating arrangement of FIG. 3*a* with the guide vane in a different position.
Figure 3C:
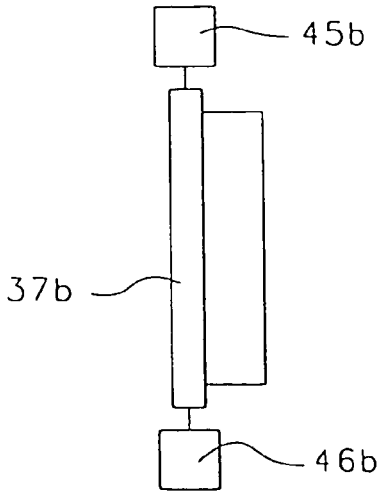
FIG. 3*c* is a top view of a part of the waste-separating arrangement of FIGS. 3*a*, 3*b*, including the guide vane together with an actuating motor and an angle-measuring element.

The cleaning apparatus illustrated in FIGS. 1*a*, 1*b* and 2 has at openings 8 to 11 devices by means of which the amount and also, to some extent, the nature of the waste being separated (foreign matter, trash, neps, good fibres etc.) can be adjusted or influenced. Those devices are in the form of motor-adjustable guide vanes 37*a* to 37*d* (referred to collectively below as 37) mounted in the region of the opener and cleaning rollers 3 to 6 upstream of the separating blades. It is possible, by means of the angular position α of those vanes 37 to influence the amount and also, to a certain extent, the nature of the material separated I (FIGS. 3*a*, 3*b*), a large angle of opening α resulting in a relatively large amount of separated material I and a small angle resulting in a correspondingly smaller amount. Stipulating the desired amount of separated material I at the same time determines very especially the cleaning action of the machine on the good material. Because it is generally the case that, with this kind of separation I, "good" fibre material will always be separated out as well, it is, in practice, necessary to find an acceptable compromise. This means that as much "bad material" as possible is separated out whilst, at the same time, separating out a minimum amount of good fibres. In order to be able to assess the waste I separated out and consequently to change the possible settings, the waste I is separated out, collected and, finally, visually assessed in the manner according to the invention.

In accordance with FIG. 2, a transparent pane 40*a* is mounted in the wall surface of the suction offtake channel 27*b*, the centre-point of which pane is aligned with the axis of the suction offtake hood 17. Associated with the pane 40*a*, on the outside of the suction offtake channel 27*b*, is a sensor arrangement 42*a* (brightness sensor) in the form of a photodiode (see FIG. 7). In addition, a light source 41 (see FIG. 7) is provided directly next to the photodiode.

Figure 2A:
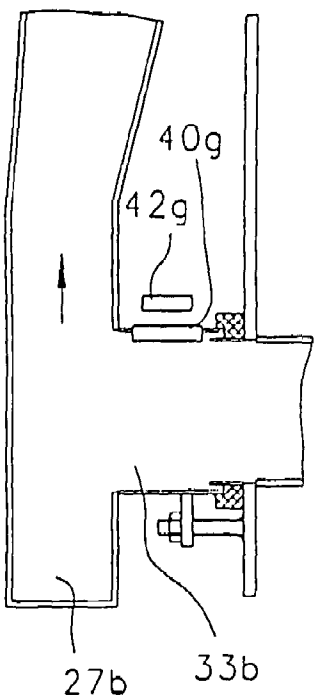
FIG. 2*a* shows an apparatus according to the invention arranged at a connection piece of a suction offtake arrangement.

In accordance with FIG. 2*a*, a pane 40*g* is arranged in the wall surface of the connection piece 33*b*, which connects the suction offtake channel 27*b* to the outlet from the suction offtake hood 17. Associated with the pane 40*g*, on the outside, is a brightness sensor 42*g*.

In accordance with FIG. 4, the waste $K_1$ to $K_8$ from the individual separation locations is combined on each side of the machine to form combined streams M, N, drawn off continuously by means of a partial vacuum and conveyed to a central filtration and separation system 44. In this case, in accordance with the invention, there is integrated in the waste channel 27*b*, at the level of, that is to say aligned with, each suction offtake hood 17 to 21, a brightness sensor 42*a* to 42*d*, together with appropriate illumination 41*a* to 41*d* (not shown in FIG. 4) and evaluation unit. The system is so arranged that fibres, foreign matter and other matter flying past in the line 27*b* can be detected. The system is furthermore so arranged that it is possible to distinguish good fibres in the waste and to provide information relating thereto. In dependence upon corresponding specified requirements, the machinery influencing the composition of the waste I (e.g. the guide vanes 37) is then automatically adjusted until the desired waste quality has been achieved.

Figure 5:
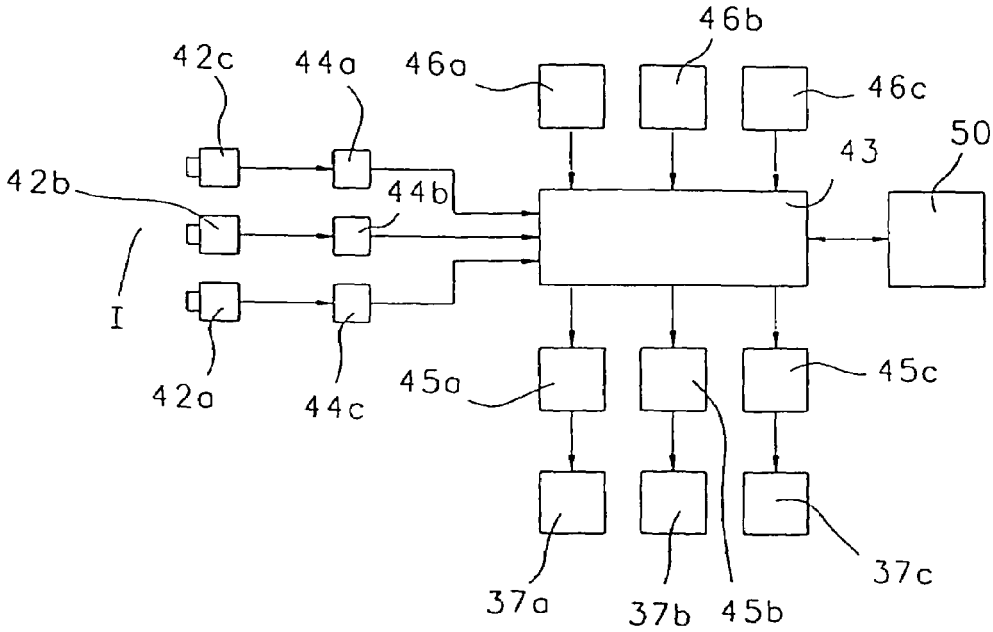
FIG. 5 is a generalised circuit diagram of an electronic control and regulation device having connected apparatuses according to the invention, an evaluation device, an angle-measuring device for guide vane angles, an operating and display device and an actuating device for guide vanes.

In accordance with FIG. 5, there are connected to an electronic control and regulation device 43 (machine control), for example a microcomputer, three sensor systems 42*a*, 42*b*, 42*c* by way of three evaluation devices 44*a*, 44*b*, 44*c*, an operating and display device 50, three angle-measuring devices 46*a*, 46*b*, 46*c* for guide vane angles α (FIGS. 3*a*, 3*b*) and three vane-adjusting devices 45*a*, 45*b*, 45*c* for adjustment of the guide vanes 37*a*, 37*b* and 37*c*, respectively.

Figure 6:
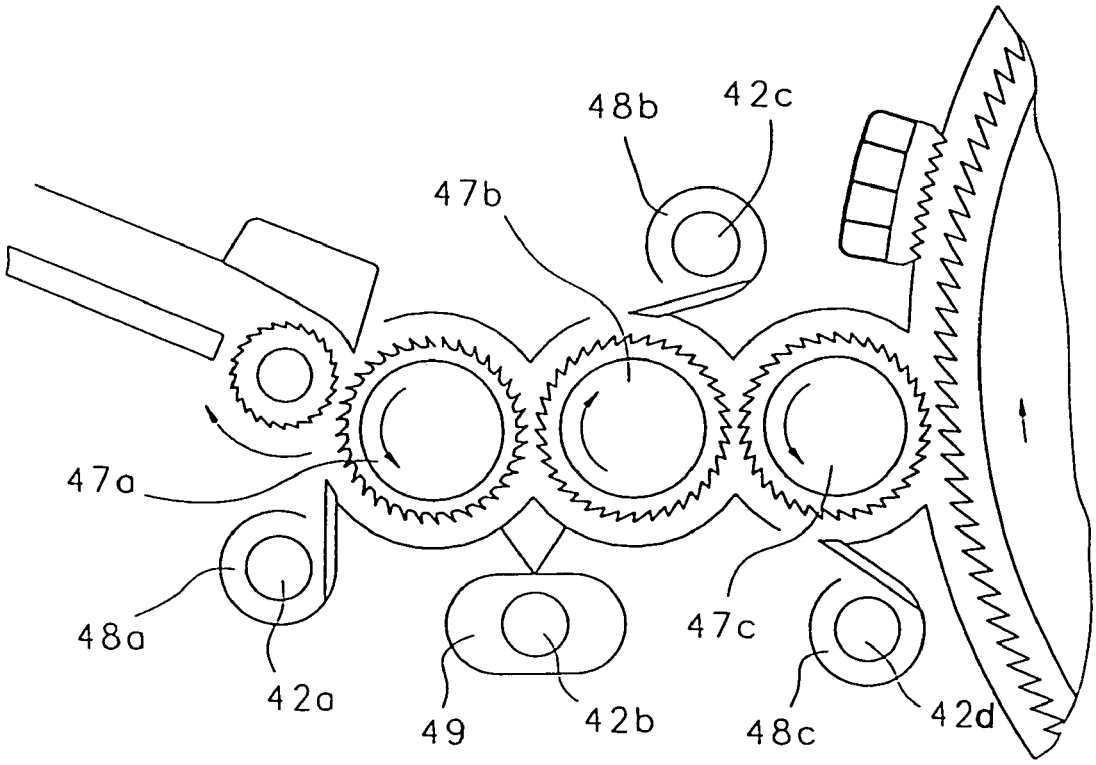
FIG. 6 is a diagrammatic side view of a feed device for a carding machine together with apparatuses according to the invention at suction waste-offtake hoods.

FIG. 6 shows a carding machine, for example a DK 903 high-performance carding machine made by Trützschler GmbH & Co. KG. There are provided, in the feed system of lickers—in 47*a*, 47*b*, 47*c*, a suction waste-offtake hood 48*a*, 48*b* and 48*c* at each roller, respectively, and also a connecting line 49 for the suction offtake hoods 48*a* to 48*c*. Associated with each of the suction offtake hoods 48*a* to 48*c* and with the connecting line 49 is a sensor system 42*a*, 42*b*, 42*c* and 42*d* (see FIG. 7).

Figure 7:
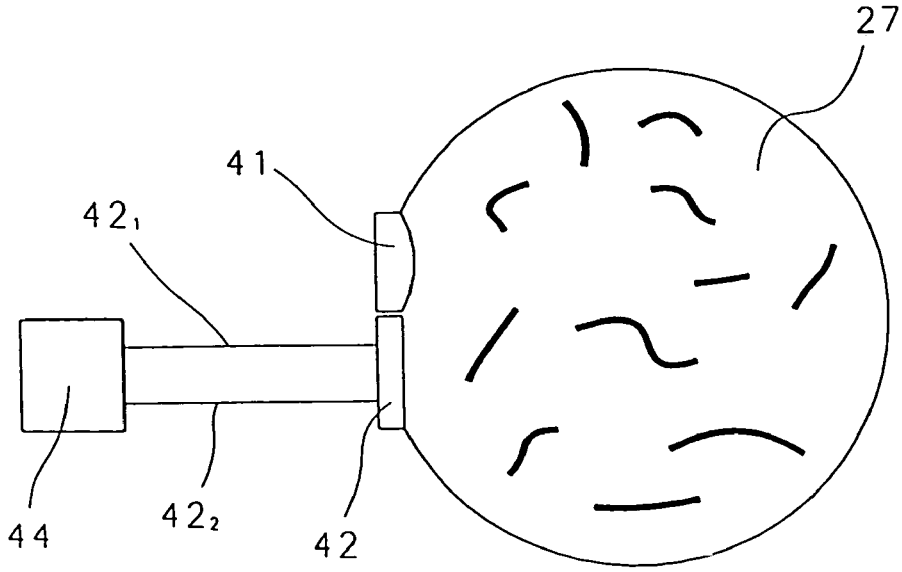
FIG. 7 shows the apparatus according to the invention comprising a photodiode, a light source and a measuring device for data collection at a waste pipe-line.

In accordance with FIG. 7, there is provided in the wall surface of the waste line 27 an opening in which there are arranged a brightness sensor 42 in the form of a photodiode and a light source 41 in the form of a direct-current visible-light illuminator. The photodiode 42 (photovoltaic element) is a signal transducer. The photodiode 42 is connected, by way of lines $\mathbf{42}_1$, $\mathbf{42}_2$, with a measurement apparatus 44 for data collection (voltage measurement apparatus). The system is based on the detection and evaluation of changes in voltage or resistance caused by reflection differences (differences in brightness caused by a difference in reflection) in spaces containing moving waste. For that purpose there is required a direct-current illuminator or high-frequency alternating-current illuminator, which is mounted at the end face or tangentially on the pipe-line or suction offtake hood of the spinning or cleaning room machine. Directly next to or even inside that illuminator there is a photosensitive element which receives the light reflected by the good fibres, converts it into current and measures the variation in reflection. The reflection is always detected in reflected incident light. An image is not required so that the detection problems caused by honeydew and other contaminants are avoided. It is solely the variations in the level of reflection (which are dependent upon the content of good fibres) that are used because it is only the variance that provides reliable information relating to the correctness of the operating point and the associated separation element setting. The optimum operating point is achieved at maximum contaminant separation and, at the same time, minimum good-fibre separation. A large amount of good fibres produces a high variation in reflection so that the variation in the current produced is correspondingly high or the remaining resistance is correspondingly low. In dependence upon that level, the separating unit can then be appropriately adjusted in order to control the amount of good fibres in the waste (cf. FIGS. 3*a*, 3*b*).

Figure 8:
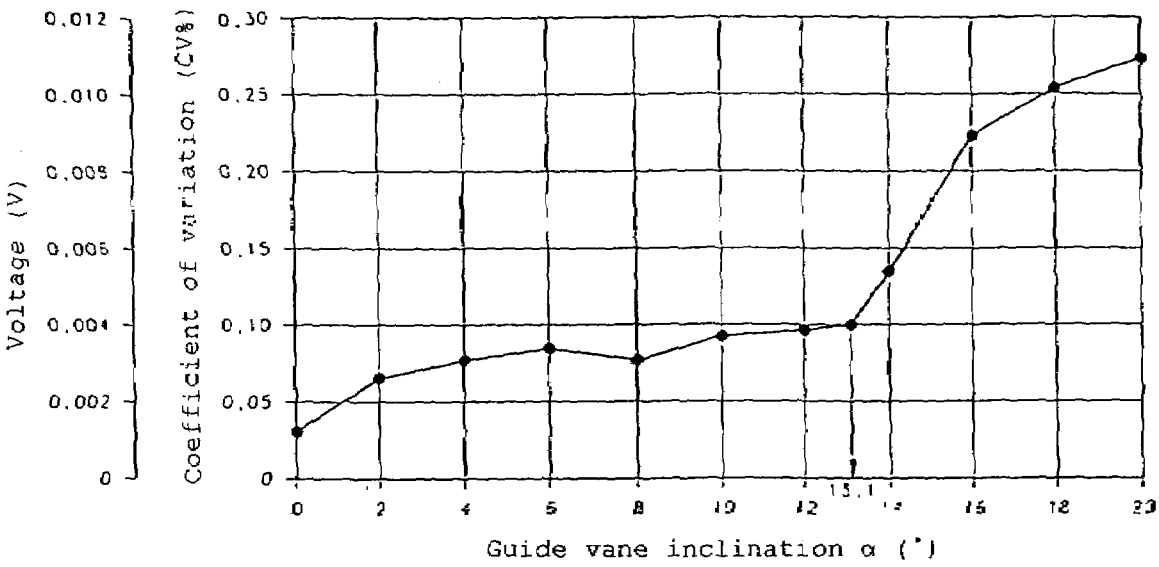
FIG. 8 is a graph showing the standard deviation (CV %) of the measurement voltage and the measurement voltage in dependence upon the guide vane position (or the width of the separation opening) and FIG. 9 is a graph showing the waste composition in dependence upon the guide vane position (or the width of the separation opening).

FIG. 8 shows the dependence of the voltage at the measurement apparatuses 44*a* to 44*c* and of the coefficient of variation of the voltage upon the guide vane angle. The coefficient of variation in % is defined as:

$$CV = 100 \cdot \frac{s}{\bar{x}}$$

CV=coefficient of variation s=standard deviation $\bar{x}$=mean

Figure 9:
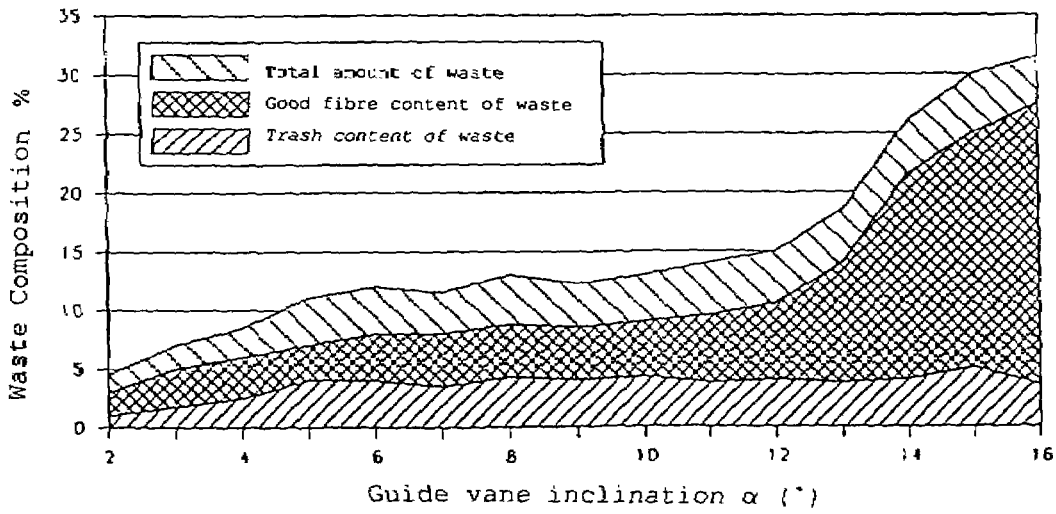

In operation, for a specific fibre material, the angle α of the guide vane 37*b* is successively increased and the corresponding voltage values are detected at the measurement apparatus 44. A large amount of good fibres in the waste results in a correspondingly high voltage value because of a correspondingly high light reflection. The voltage measurement values of the measurement apparatuses 44*a* to 44*c* and the guide vane angles α of the angle-measuring devices 46*a* to 46*c* are input into the computer 43, which calculates the coefficient of variation (CV %) of the voltage and the functional dependence of the coefficient of variation on the guide vane angle α in accordance with the graph in FIG. 8. In the curve according to FIG. 8, at an angle α=13.1°, there is a characteristic change in the gradient which corresponds to the optimum operating point of the cleaning machine. At angle settings α>13.1°, the content of good fibres in the waste increases steeply, in undesirable manner, compared to the foreign matter and trash content (cf. FIG. 9). Then, by way of the actuating elements 45*a* to 45*c*, for example stepper motors, the inclination α of the guide vanes 37*a* to 37*c* is set to α=13.1° in accordance with the optimum operating point. The procedure described above is carried out automatically—during ongoing production or in a preliminary test run. The optimum operating point can be monitored and, in the event of departures therefrom, can be re-set automatically.

By means of the apparatus according to the invention, the irregularity of the stream of waste separated out is assessed in terms of its degree of opening. The irregularity is measured on the basis of the standard deviation of the light reflected by the individual items separated out. As a result of the incident light method, the contaminant content of the items is invisible to the sensor so that, with this measurement method, neither the contaminant content nor the brightness of the separated-out waste is assessed but rather only the variation in the brightness of the good fibres.

In order to measure the quantitative waste distribution (trash/good fibres) it is also possible, in principle, to use infra-red light because the trash content of the waste reflects strongly in the infra-red range. From the voltage (resistance) difference between white-light and infra-red illumination it is possible to calculate the contents of trash and good fibres. The area of use encompasses all fibre- and waste-conveying channels but not waste chambers containing waste that is at rest.

The sensor in accordance with the invention can advantageously used to determine a state of blockage in the suction offtake hood, in which case the machine control issues an error message. That may be advantageously accomplished by means of the fact that the normally dynamic signal changes to a static state as a result of the blockage, that static signal course being interpreted as an indication of a blockage, or by means of the fact that the signal exceeds or falls below certain limit values as a result of the blockage.

Although the foregoing invention has been described in detail by way of illustration and example for purposes of understanding, it will be obvious that changes and modifications may be practised within the scope of the appended claims.

The invention claimed is:

1. A spinning preparation machine in which waste is separated from fibre material, comprising:

an apparatus through which the waste moves, the waste comprising good fibers and contaminants;

a sensor arrangement comprising a light source adapted to project light onto the waste, and a photoelectric sensor adapted to detect light reflected solely from the good fibers located in the waste and convert the reflected light into electrical signals;

a measurement element adapted to measure the electrical signals; and an electronic evaluation device arranged to determine one or more parameters selected from: the variation of the brightness of the light reflected solely by the good fibres; the coefficient of variation of the brightness of the light reflected solely by the good fibres; and the standard deviation of the brightness of the light reflected solely by the good fibres.

2. The machine according to claim 1, in which the measurement element is adapted to detect changes in voltage caused by differences in brightness.

3. The machine according to claim 1, comprising a plurality of light sources of different colours.

4. The machine according to claim 1, further comprising a collecting device for the waste, wherein the photoelectric sensor is arranged to monitor waste in the collecting device.

5. The machine according to claim 4, in which the collecting device is a pneumatic pipe-line.

6. The machine according to claim 4, in which the collecting device is a suction removal hood.

7. The machine according to claim 4, in which the waste is conveyed through the collecting device.

8. The machine according to claim 4, in which the photoelectric sensor is arranged in a wall region of the collecting device.

9. The machine according to claim 4, in which there are a plurality of suction removal hoods and guide vanes, and at least one separate photoelectric sensor is associated with each suction hood location or each guide vane.

10. The machine according to claim 4, comprising a central waste-collecting line, the photoelectric sensor being associated with the central waste-collecting line.

11. The machine according to claim 1, comprising a control device adapted to compare the measured electrical signals with prespecified quantities and, in the event of a departure therefrom, effect a modification of the waste separation.

12. The machine according to claim 1, which comprises at least one waste separation element being adjustable in dependence on measurement results from the evaluation device.

13. The machine according to claim 12, in which the or each waste separation element is a guide vane or a separating blade.

14. The machine according to claim 12, which further comprises at least one angle-measuring device, the angle-measuring device and the evaluation device being connected to a control and regulation device.

15. The machine according to claim 1, in which the measured electrical signals are usable in a control and regulation circuit for optimizing the cleaning of the fibre material.

16. The machine according to claim 1, in which the sensor arrangement is adapted to detect a blockage of fibre material in the collecting device.

17. A spinning preparation machine in which waste is separated from fibre material, comprising:

a collecting device through which the waste moves, the waste comprising good fibers and contaminants;

at least one sensor arrangement associated with the collecting device, the sensor arrangement comprising a light source adapted to project light onto the waste, and a photoelectric sensor adapted to detect light reflected solely by the good fibres in the waste and convert the reflected light into electrical signals;

measuring element adapted to measure the electrical signals; and an electronic evaluation device arranged to determine one or more parameters selected from: the variation of the brightness of the light reflected solely by the good fibres; the coefficient of variation of the brightness of the light reflected solely by the good fibres; and the standard deviation of the brightness of the light reflected solely by the good fibres.

* * * * *